United States Patent [19]

Ditscherlein

[11] Patent Number: 4,939,871

[45] Date of Patent: Jul. 10, 1990

[54] CENTRIFUGAL PROCESSING MACHINE

[75] Inventor: Friedhold Ditscherlein, Bocholt, Fed. Rep. of Germany

[73] Assignee: Max Spaleck GmbH & Co., Bocholt, Fed. Rep. of Germany

[21] Appl. No.: 303,551

[22] Filed: Jan. 27, 1989

[30] Foreign Application Priority Data

Jan. 28, 1988 [DE] Fed. Rep. of Germany ..... 3802542

[51] Int. Cl.[5] ..... B24B 31/02

[52] U.S. Cl. ..... 51/163.2; 51/165 R

[58] Field of Search ..... 51/163.2, 165.71, 165.73, 51/165.74, 165.78, 7, 17, 163.1, 165 R, 164.1; 73/599

[56] References Cited

U.S. PATENT DOCUMENTS

| | | | |
|---|---|---|---|
| 3,863,493 | 2/1975 | Busenkell . | |
| 4,030,247 | 7/1977 | Grund et al. | 51/164.1 |
| 4,042,181 | 8/1977 | Huber et al. | 51/163.2 |
| 4,175,441 | 11/1979 | Urbanek et al. | 73/599 |
| 4,452,016 | 6/1984 | Majors | 51/163.2 |
| 4,603,844 | 8/1986 | Chen . | |

FOREIGN PATENT DOCUMENTS 171527 5/1985 European Pat. Off. .

*Primary Examiner*—D. S. Meislin
*Assistant Examiner*—Mark F. Frazier
*Attorney, Agent, or Firm*—A. Thomas S. Safford

[57] ABSTRACT

A centrifugal processing machine for the merchanical processing, for example, grinding, polishing, cleaning and de-burring of workpieces, with a container serving to accommodate the work-pieces and processing agents. The container comprises a substantially cylindrical casing and a rotating bottom, in the form of a plate or similar dished structure, mounted coaxially with the casing. The peripheral edge of the bottom projects towards the cylindrical casing and forms a narrow gap. For adjusting automatically the width of the gap around the entire periphery of the container, as a function of a given or varying gap-width, the casing is adapted to be raised and lowered in relation to the bottom. This is accomplished by means of a measuring device, which measures the width of the gap, and by means of a device for raising and lowering the casing which is adapted to be controlled by the measuring device in such a manner that the width of the gap is adjusted to a specific value and is held at this value.

14 Claims, 3 Drawing Sheets

Fig.4
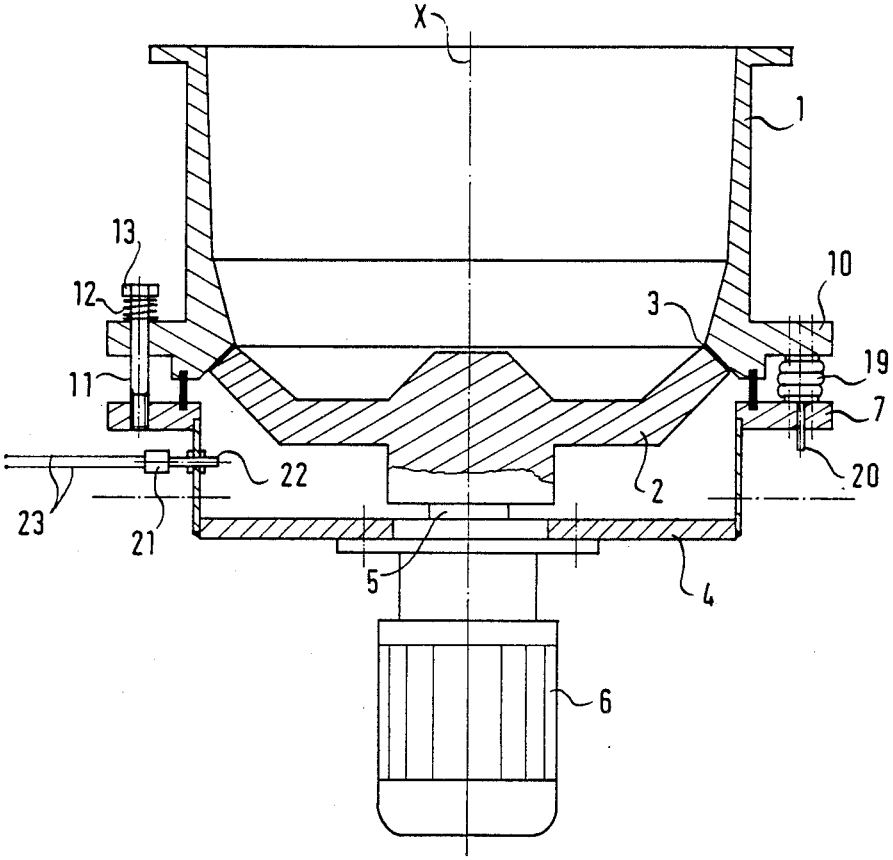
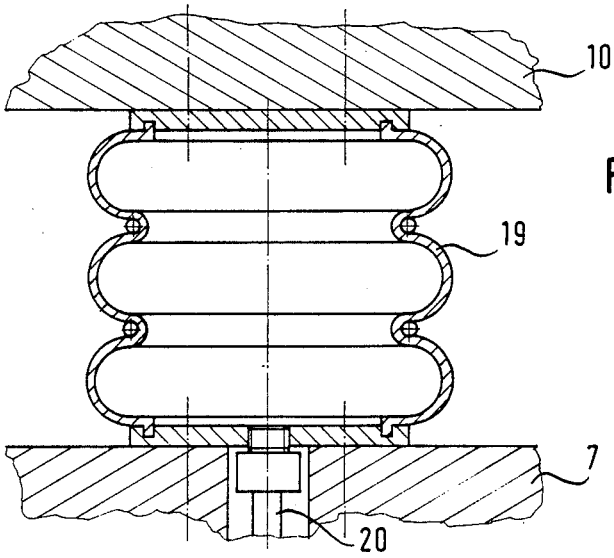
Fig.5

CENTRIFUGAL PROCESSING MACHINE

The invention relates to a centrifugal processing machine for the mechanical processing, for example, grinding, polishing cleaning and de-burring of workpieces, with a container serving to accommodate the workpieces and processing agents, the said container comprising a substantially cylindrical casing and a rotating bottom, in the form of a plate or similar dished structure, mounted coaxially with the said casing, the peripheral edge of the said bottom projecting towards the cylindrical casing and forming a narrow gap. The said container-casing and rotating bottom are mounted upon a common supporting device or upon separate supporting devices. In the case of the machine relating to the invention, the said casing is adapted to be raised and lowered, in relation to the bottom, for the purpose of adjusting the width of the gap around the entire periphery of the container.

A machine having a container-casing which is adapted to be raised and lowered in relation to the rotating bottom is already known (EP-Bl-0171527). In this case the width of the gap may be adjusted and re-adjusted to the desired dimension. Re-adjustment is highly desirable, even necessary, if the width of the gap varies, while the machine is in operation, as a result of wear in the walls defining the gap, of swelling or thermal expansion of the material of which the container-casing and the rotating bottom are made.

For instance, the gap may diminish by more than 1 mm due to thermal expansion of the container casing, and of the container-bottom in particular, depending upon the nature of the materials of which they are made, if the workpiece-container is heated by grinding and friction from room-temperature, when the machine is started up, to more than 80° C. when the machine is in operation. Wear in the walls defining the gap is also not inconsiderable, being caused by continuous removal, during the processing, of the grinding agent used in the workpiece-container, and of the processing fluid, through the said gap.

However, during the processing of workpieces of small dimensions in particular, a specific gap-width is of great importance, on the one hand in order to prevent workpieces from entering the gap, resulting in damage to the said workpieces and to the walls defining the gap and, on the other hand, to prevent excessive flow of fluid and grinding agent through the said gap.

In the aforesaid known machine, adjustment of the gap is effected by providing adjusting screws for raising and lowering the container casing, the said screws supporting the container-casing upon its supporting device. However, this manual adjustment can ensure an accurate and longlasting gap-width only if it is carried out with the greatest accuracy in accordance with the change in the width of the gap. This requires constant observation of recording of the width of the gap and changes therein and also frequent and accurate readjustment.

It is therefore the purpose of the invention to eliminate the problems arising with hitherto known machines having manual adjustment of the gap-width, i.e. to design a machine which will ensure a constant gap-width without the need for constant checking. According to the invention, this is accomplished in that raising and lowering of the container-casing in relation to the bottom is effected automatically as a function of a given or varying gap-width. To this end, a mechanically, hydraulically, pneumatically or electrically operated device for measuring the width of the gap is provided and is connected to a device for automatically raising and lowering the casing. This is adapted to be controlled by the results of the measuring device in such a manner that the gap-width is adjusted to a specific value and is held at this value. A device of this kind makes it possible to maintain a constant gap-width over the entire operating process of the machine. This ensures that relatively thin workpieces, measuring less than 0.5 mm, can be processed, but prevents workpieces from entering and lodging in the gap and thus destroying or damaging the walls of the container-casing defining the gap or the rotating bottom.

The above-mentioned measuring device, provided with the machine according to the invention, may consist of a hydraulic or pneumatic pitot-head which is arranged in a line supplying the gap with a fluid or gaseous medium and which measures the dynamic pressure in this line which varies with the width of the gap. Measurement of the dynamic pressure may be carried out by means of a pressure-sensor, for example an inductive or piezo-resistive pressure-transducer of commercial design (e.g. the "JUMO" made by M.K. Juchheim Gmbh & Co., Fulda/BRD), whereby the measured pressure, or the measured changes in pressure, are converted into electrical signals controlling the raising and lowering device. Further possible measuring devices are set forth below.

The device for automatically raising and lowering the container-casing may, with advantage, consist of one or more resiliently compressible, pneumatically or hydraulically operated pads which bear, at the periphery of the casing, upon a supporting device arranged at an unalterable height in relation to the rotating bottom and which support the container-casing. The said pad, or pads, may be in the form of a tube or corresponding sections of tubes arranged at the periphery of the container between the supporting device and the container-casing. However, the said pads may also consist of a plurality of bellows or so-called air-springs, or may be in the form of pneumatic or hydraulic lifting cylinders, the pneumatic or hydraulic fillings of which are adapted to be controlled by the device which measures the width of the gap. Vertically operating threaded spindles may also be used for this purpose, the said spindles being driven by motors connected to the measuring device and controlled thereby.

Particularly advantageous examples of embodiments of the centrifugal processing machine according to the invention are described hereinafter in greater detail in conjunction with the drawings attached hereto, wherein:

FIG. 4 is a view, similar to that in FIG. 1, of a second example of an embodiment of the machine according to the invention;

FIG. 5 is a cross-section through a bellows of the raising and lowering device of the example of FIG. 4;

Figure 1:
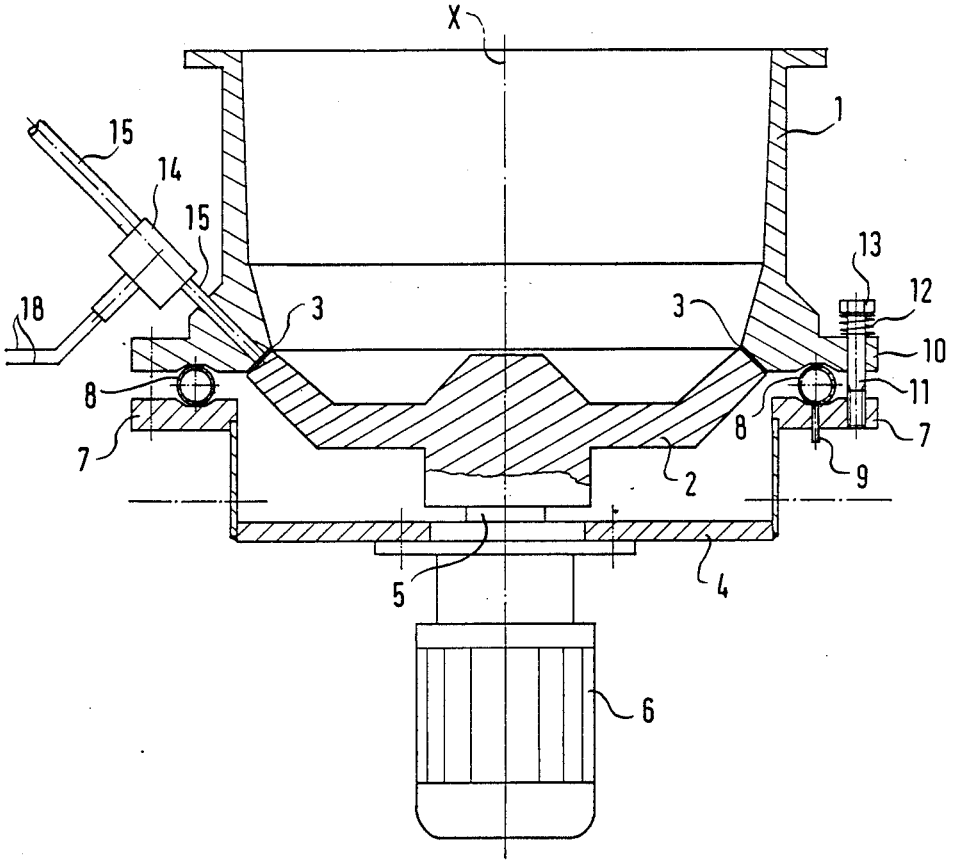
FIG. 1 shows the first example of an embodiment in axial section through the workpiece -container and its supporting and driving device.

In all of the embodiments illustrated, the processing container consists of an upper cylindrical casing 1 and of a lower rotating dish-like bottom 2 mounted coaxially therewith, the peripheral edge of the said bottom projecting towards the lower edge of the casing to form a gap 3. Arranged under the dish-like bottom is a collecting-container 4 for the processing fluid flowing through gap 3. Passing through the bottom of this container is the drive-shaft 5 of the dish-like bottom, the said shaft being adapted to be driven by motor 6 arranged under collecting-container 4.

Lower collecting-container 4 also constitutes the supporting device for container-casing 1. To this end, in the embodiment according to FIGS. 1 to 3, this collecting container, which is circular in plan view, carries, at its upper edge, a flange 7 which extends radially around its entire edge and comprises a peripheral depression in which is mounted an annular hydraulic or pneumatic resilient pressure-tube 8 which is adapted to be compressed, in its cross-section, substantially radially. This pressure-tube is provided with a line 9 for the feed and return of a fluid or gaseous medium with which the said pressure-tube is filled and pressurized. Radial flange 10, arranged on the lower edge of casing 1, bears upon pressure-tube 8 and, like flange 7 on lower container 4, carries a depression for the accommodation of the pressure-tube.

Figure 3:
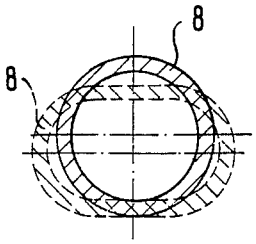
FIG. 3 is a cross-section, in two different positions (one being in dotted outline), of the hydraulic or pneumatic tube provided, in the example of FIG. 1, for raising and lowering the container-casing.

The weight of container-casing 1 imposes upon tube 8 a load which endeavors to compress the said tube from the circular cross-sectional shape shown in FIG. 3 to the flattened cross-section shape of lesser height shown in dotted outline in the same figure. This compression may be prevented or controlled, depending upon the pressure applied by the fluidic medium, hydraulic or pneumatic, contained in the tube. This allows container-casing 1 to be raised or lowered, thus varying the width of gap 3 which, in the case of the example illustrated, runs at an angle of about 45° to the axis of the container. Other gap-angles, in relation to the axis of the container, may also be used, but the change in height of the container-casing, effected by the raising and lowering device in the form of pressure-tube 8, becomes less as the angle between the gap and the container-axis decreases.

In the interests of minimal abrasion of the edges of rotating bottom 2 and of container-casing 1 on the inside of gap 3, it is desirable to select the angle of gap 3 in relating to the container-axis X to ensure that no sharp edges arise.

It is possible for pressure-tube 8 to extend, not only around the entire periphery of the container, but only over a major part thereof. It is also possible to provide a plurality of tube-sections extending over a part of the periphery of the container, each of the said sections being connected, through a line 9, to the source of pressure for these sections. In these cases, seals must be provided between flanges 7, 10 of collecting-container 4 and casing 1 of the processing container. In order to maintain the central position of container-casing 1 in relating to rotating bottom 2, guide-bolts 11 are distributed uniformly around the periphery of container-casing 1. These bolts run parallel with container-axis X and are screwed to flange 7 of supporting device 4. They pass through holes in flange 10 of container-casing 1 which moves up and down on them. The ends of the bolts carry, above flange 10, compression-springs 12 which bear, on the one hand, upon heads 13 of the bolts and, on the other hand, upon the upper surface of flange 10. Container-casing 1 is thus urged towards supporting device 4 and tube 8 is compressed.

The measuring device serving to raise and lower the container casing consists, in this embodiment, of a pressure-transducer 14 arranged in a hydraulic or pneumatic feed-line 15 which opens, at the lower edge of casing 1, into gap 3. A fluid or gaseous medium is introduced, through this line, into the said gap, in such a manner that the said medium impinges approximately perpendicularly upon the edge of bottom 2 defining gap 3. The amount of medium flowing from the gap is dependent upon the width thereof. The dynamic pressure thus arising in the medium in feed-line 15 decreased, with a constant flow, as gap 3 becomes wider and increases as the gap becomes narrower. This change in dynamic pressure is measured by the pressure-transducer and is converted into electrical signals which are passed, through electrical leads 18, to an electronic control-device not shown. By means of a pressure-control valve not shown in the drawing, for example, and located in line 9 running from the source of the medium to tube 8, this control regulates the pressure of the medium in tube 8. This allows the dynamic-pressure values determined by pressure-transducer 14 in feed-line 15, which indicate the width of the gap, to be used for automatic raising and lowering of container-casing 1 and thus for automatic adjustment of the width of gap 3.

Pressure-tube 8, which is provided in this embodiment and extends around the entire periphery of the container is not used merely to raise and lower container-casing 1. It also provides a satisfactory seal between the container-casing and collecting container 4 which carries it. The result of this is that all of the processing fluid emerging from the processing-container through gap 3 is collected in container 4.

Figure 2:
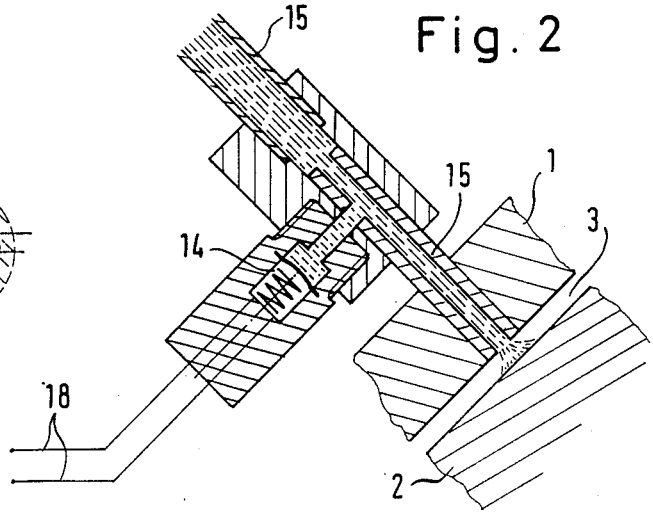
FIG. 2 is a cross-section, to an enlarged scale, through this device, provided in this example of FIG. 1, for measuring the width of the gap.

As regards design and arrangement of casing 1 and of dish-like bottom 2 of the processing container, of gap 3 lying therebetween, of collecting container 4 acting as the supporting device for the container, of the mounting and driving of bottom 2, and of the guiding of the container-casing, the embodiment illustrated in FIGS. 4 and 5 does not differ, or does not differ substantially, from the embodiment according to FIGS. 1 to 3. The same parts therefore bear the same reference-numerals in the drawings. In this example, however, the device for raising and lowering casing 1 of the processing container consists, not of a peripheral pressure-tube, but of pressure-bellows 19 distributed around the periphery of the container and connected to a feed-line 20, for a hydraulic or pneumatic pressure-medium, in the same way as pressure-tube 8 in the example according to FIGS. 1 to 3. Pressure-pads of a different design may also be used instead of pressure-bellows. In this case, the width of the gap is ensured by means of a temperature-measuring device 21 comprising a temperature sensor 22 projecting into collecting-container 4 and used to measure the temperature of the fluid in the said container. Values determined by temperature-measuring device 21 are passed on electrically, through signal lines 23, to the device used to control the pneumatic or hydraulic pressure in pressure-bellows or pads 19.

In this example, therefore, the width of the gap is not sensed directly, but only indirectly by the temperature of the fluid draining into collecting-container 4 through gap 3, upon which temperature the thermal expansion of the parts of the processing-container depends, the said thermal expansion influencing the width of the gap.

Figure 6:
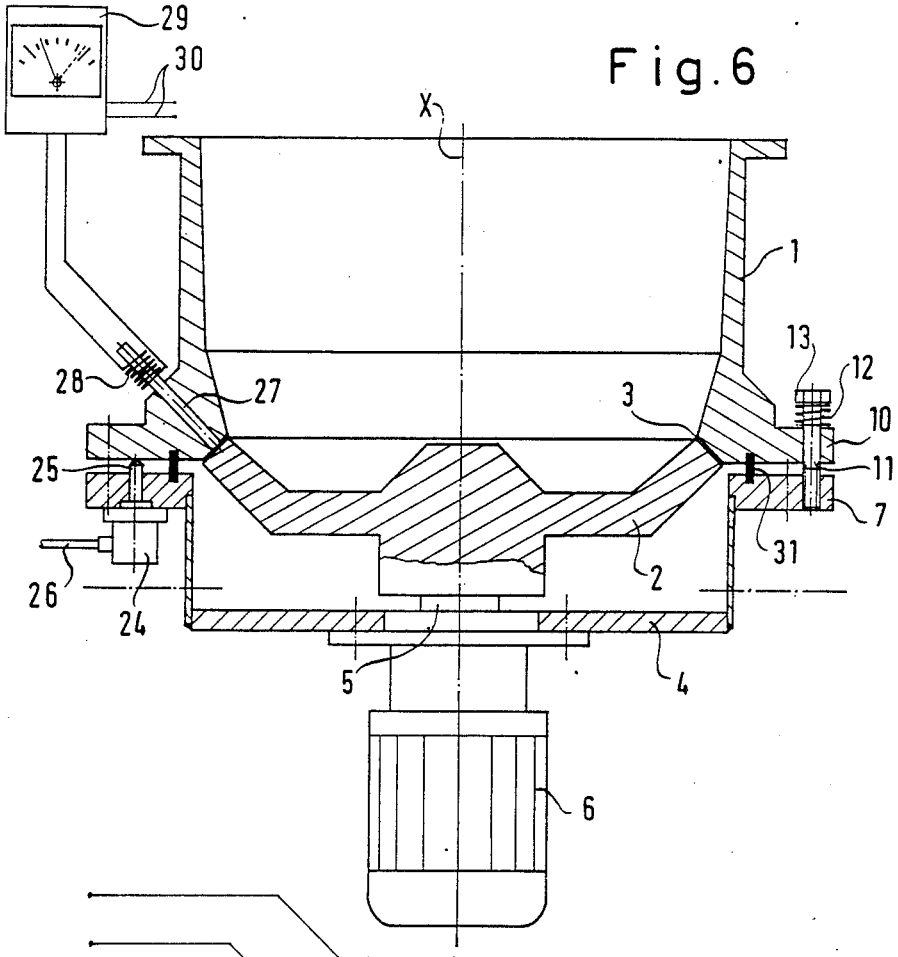
FIG. 6 is a view, similar to that in FIG. 1, of a third example of an embodiment of the machine according to the invention.
Figure 7:
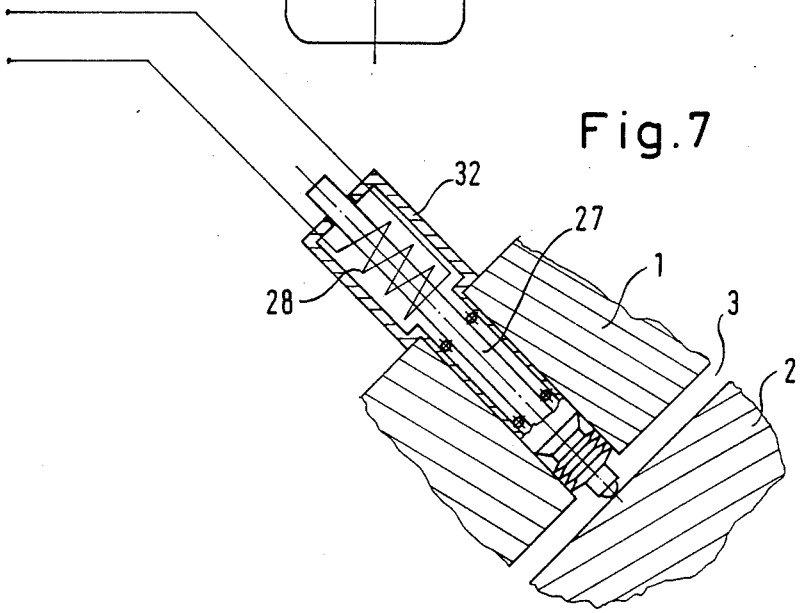
FIG. 7 shows a detail in FIG. 6, to an enlarged scale, in cross-section.

Again in the case of the embodiment according to FIG. 6, the processing-container with casing 1 and bottom 2, gap 3, collecting container 4 constituting the supporting device for casing 1, the drive for bottom 2, and the guidance for the up-and-down movement of container-casing 1 are of the same design as in FIGS. 1 to 3 and bear the same reference numerals. In this embodiment, the raising and lowering device is in the form of pneumatic or hydraulic lifting cylinders 24 which are distributed uniformly around flange 7 of collecting container 4 and comprise pistons 25 projecting upwardly against flange 10 of casing 1 of the processing container, and upon the end faces of which casing 1, with its flange 10, bears. These cylinders are connected to a source of pressure through pneumatic or hydraulic lines 26, the said source controlling the supply of pressure-medium to the aforesaid lifting cylinders. This control is effected by the measuring device which in this example, is in the form of a mechanical sensor 27 adapted to be moved into the gap. This sensor is mounted displaceably, in the direction of the width of the gap, in the lower edge, defining gap 3, in a housing inserted into casing 1, and may be advanced, with its head, by a force applied thereto from time to time as necessary, until it comes to bear upon the edge of bottom 2. This advanced position of sensor 27 is measured by an inductive scanner 28 and is displayed upon a measuring clockwork 29. The results of the measurement are passed on, through signal lines 30, to the control of the source of pressure-medium which feeds lifting cylinders 24.

If, while the processing machine is in operation, sensor 27 fails to bear constantly upon the wall of rotating bottom 2, heavy wear is avoided. By automatic control, this sensor may be advanced while the machine is in operation, at adjustable or established intervals of time, and may be caused to bear briefly upon the wall of rotating bottom 2, being returned to its initial position, as soon as the width of the gap has been measured, so that it no longer bears upon the said wall.

In this embodiment again, in order to ensure an adequate seal between casing 1 of the processing container and collecting-container 4 therebelow, a resilient sealing ring 31 is arranged between flanges 7 and 10.

It is also possible to use, as raising and measuring devices, threaded spindles which operate substantially vertically and which are preferably mounted upon the supporting device for casing 1 of the processing-container, for example, in the embodiment illustrated, upon flange 7 of collecting container 4, thus carrying casing 1 the said threaded spindles being connected to the measuring device and being adapted to be driven by the motors controlled thereby.

It is also possible to arrange the measuring device externally of the lower edge of container-casing 1, and to allow it to act, externally of gap 3, upon an expansion, in this direction, of the edge of rotating bottom 2.

If the raising and lowering device according to the invention is of the pneumatic or hydraulic type, as in the designs according to FIGS. 1 to 5, for example, it may be desirable to provide, in the pneumatic or hydraulic feed-lines, manually operated elements for individual adjustment of the raising and lowering pressure of this device independently of the results provided by the measuring device, so that casing 1 of the processing container may also be raised and lowered independently of the results provided by the said measuring device.

What is claimed is:

1. A centrifugal processing machine for the mechanical processing, e.g., grinding, polishing, cleaning and deburring of workpieces, with a container serving to accommodate the workpieces and processing agents, said container comprising a substantially cylindrical casing;

a rotating bottom, in the form of a plate or similar dished structure, mounted coaxially with said casing, the peripheral edge of said bottom projecting towards the cylindrical casing and forming a narrow gap with respect to said casing;

said casing being adapted to be raised and lowered in relation to the bottom, for the purpose of adjusting automatically the width of the gap around the entire periphery of the container as a function of a controlled gap-width;

a measuring means chosen from the group consisting of mechanically, hydraulically, pneumatically, and electronically operated devices for measuring the width of the gap;

an adjusting means for automatically raising and lowering the casing and being controlled by the measuring means in such a manner that the gap-width is adjusted to a specific value and is held to this value; and a support for said casing.

2. A machine according to claim 1, wherein the measuring means is in the form of a fluidic pitot-head which is mounted in a wall of said casing defining said gap with a fluidic feed-line which is directed to one of the two walls defining the gap, approximately at right angles to the opposing wall of the gap, at least close to the gap.

3. A machine according to claim 2, wherein the fluidic feed-line is arranged in a lower edge, defining the gap, of the container casing.

4. A machine according to claim 2, wherein the pitot-head comprises a pressure-transducer releasing its measuring results electrically.

5. A machine according to claim 1, wherein the measuring means comprises at least one mechanical sensor which is displaceably mounted on said casing at least adjacent a lower edge of said casing defining the gap, in such a manner so as to be adapted to advance to bear against the opposing peripheral edge of the bottom.

6. A machine according to claim 2, further comprising a supporting device for said container, and wherein the adjusting means for carrying and automatically raising and lowering the container-casing consists of at least one resiliently compressible, fluidically actuated pads bearing upon the supporting device secured to the periphery of the container at a fixed height in relation to the bottom.

7. A machine according to claim 6, wherein the pad consists of at least sections of resilient annular peripheral tubing arranged between the supporting device and the container-casing.

8. A machine according to claim 7, wherein the inside diameter of at least some sections of the tubing is between 15 and 30 mm.

9. A machine according to claim 6, wherein the pad consists of at least one fluidic spring.

10. A machine according to claim 6, wherein the inside diameter of said pad is between 15 and 30 mm.

11. A machine according to claim 1, wherein the measuring means is a temperature-measuring device which is connected to the drive and to the adjusting means for raising and lowering the container-casing and comprises a temperature-sensor which is arranged in a collecting chamber below the bottom of the container-casing and measures the temperature of the fluid located in one of said collecting chamber and said interior of the container.

12. A machine according to claim 1, wherein the device for automatically raising and lowering the container-casing consists of piston-cylinder units distributed around the periphery of the container.

13. A machine according to claim 1, wherein the adjusting means for automatically raising and lowering the container-casing consists of threaded spindles which are distributed around the periphery of the container, which operate substantially vertically and which are motor-driven.

14. A machine according to claim 1, further comprising supply means for furnishing processing materials to said container.

* * * * *